US009209573B1

(12) United States Patent
Chen

(10) Patent No.: US 9,209,573 B1
(45) Date of Patent: Dec. 8, 2015

(54) ELECTRIC CONNECTOR ASSEMBLY

(71) Applicants: YUE SHENG EXACT INDUSTRIAL CO., LTD., New Taipei (TW); ASSEM TECHNOLOGY CO., LTD., New Taipei (TW)

(72) Inventor: Chiu-Sheng Chen, New Taipei (TW)

(73) Assignees: Yue Sheng Exact Industrial Co., Ltd., New Taipei (TW); Assem Technology Co., Ltd., New Taipei (TW)

( * ) Notice: Subject to any disclaimer, the term of this patent is extended or adjusted under 35 U.S.C. 154(b) by 0 days.

(21) Appl. No.: 14/613,328

(22) Filed: Feb. 3, 2015

(51) Int. Cl.

| | |
|---|---|
| ***H01R 13/648*** | (2006.01) |
| ***H01R 13/6581*** | (2011.01) |
| ***H01R 24/60*** | (2011.01) |
| *H01R 107/00* | (2006.01) |

(52) U.S. Cl.
CPC ..... *H01R 13/6581* (2013.01); *H01R 24/60* (2013.01); *H01R 2107/00* (2013.01)

(58) Field of Classification Search
CPC ..... H01R 23/6973; H01R 23/7073; H01R 13/65802; H01R 13/658; H01R 23/7021
USPC ..... 439/607.4, 607.35, 607.36, 607.09
See application file for complete search history.

(56) References Cited

U.S. PATENT DOCUMENTS

| | | | | |
|---|---|---|---|---|
| 7,758,329 | B2 * | 7/2010 | Kihara | B29C 67/0066 264/492 |
| 7,758,379 | B2 * | 7/2010 | Chen | H01R 13/6485 439/607.11 |
| 8,262,411 | B2 * | 9/2012 | Kondo | H01R 13/6658 439/607.01 |
| 8,851,927 | B2 * | 10/2014 | Hsu | H01R 13/6594 439/607.11 |

* cited by examiner

*Primary Examiner* — Phuong Dinh
(74) *Attorney, Agent, or Firm* — Leong C. Lei

(57) ABSTRACT

An electric connector assembly includes a first terminal module, a second terminal module, a grounded metal plate, an insulating body, an inner shield casing and an outer shield casing. The first terminal module, the grounded metal plate and the second terminal module are spaced from one another and integrally formed and embedded into the insulating body, and a tongue plate is formed at a front section, so that the first terminal module and the second terminal module are disposed at upper and lower surfaces of the tongue plate respectively, and the grounded metal plate is completely covered by the insulating body, and the inner shield casing is fixed at a middle section of the insulating body, and the outer shield casing covers the exterior of the insulating body to form an engaging portion around the external space of the tongue plate.

6 Claims, 6 Drawing Sheets

ELECTRIC CONNECTOR ASSEMBLY

BACKGROUND OF THE INVENTION

1. Field of the Invention

The present invention relates to the field electric connectors, and more particularly to an electric connector assembly with a compact size and capable of preventing a short circuit of a grounded metal plate and a terminal, simplifying the assembling process and improving the assembling quality.

2. Description of the Related Art

In general, an electric connector serves as a main channel for the electrical connection and information exchange of various electronic products. Since the electric connector conducts an information exchange of electronic signals through each terminal installed in the electric connector, and noises or incomplete signal transmissions occur during a signal transmission due to electromagnetic interference, therefore, some electric connectors may include a shield member embedded in the insulating body for providing an electromagnetic shielding effect to improve the quality of signal transmissions.

The conventional electric connector assembly generally comprises an insulating body, a first terminal module, a second terminal module, a shield member and a metal casing. Wherein, the insulating body is formed by engaging a first insulator with a second insulator to form a base and a forwardly extended tongue plate, and the first terminals of the first terminal module are arranged with an interval apart from one another and disposed on the top side of the first insulator, and the second terminals of the second terminal module are arranged with an interval apart from one another and disposed on the bottom side of the second insulator, and the shield member is clamped between the first insulator and the second insulator when the first and second insulator are engaged with each other, and finally the metal casing is enclosed and covered onto the exterior of the insulating body.

However, the structure of the grounding terminal of the shield member of the aforementioned electric connector is lack of elasticity, not just failing to provide stable contact or good grounding only, but also causing poor contact due to a slight deviation or deformation of each first terminal, each second terminal and the grounding terminal occurred in the assembling process. In addition, the grounding channel of the shield member seldom provides a good grounding effect, so that the conventional electric connector requires improvements.

In addition, the grounding terminals of each first terminal, each second terminal, and the shield member of the electric connector are extended in the rear side and divided into a plurality of terminals spaced from one another, so that when the soldering takes place, it is necessary coat a layer of insulating material at the external periphery of the downwardly bending position of the terminals first in order to increase the distance between two adjacent rows of terminals at the soldering positions. As a result, the space from a front-end surface of the base to a rear-end surface of the insulating body of the electric connector becomes bigger, and a bigger space is not conducive to the miniaturization of the electronic product.

Therefore, the inventor of the present invention designed and developed an electric connector assembly in accordance with the present invention to overcome the aforementioned drawbacks and problems of the conventional probe structure.

SUMMARY OF THE INVENTION

In view of the problems of the prior art, it is a primary objective of the present invention to overcome the problems of the prior art by providing an electric connector assembly, wherein a first terminal module, a grounded metal plate and a second terminal module are arranged sequentially with an interval apart from one another by a snap-in molding method, and integrally formed and covered inside an insulating body, so as to achieve the effects of simplifying the assembling process and lowering the manufacturing cost. Since the snap-in molding method can cover the first terminal module, the grounded metal plate and the second terminal module completely in the insulating body, the quality of high frequency transmission is enhanced.

To achieve the aforementioned objective, the present invention provides an electric connector assembly, comprising: a first terminal module, including a plurality of first terminals arranged parallel to and spaced from one another, and the rear end of each first terminal being bent and having a first pin installed vertically; a second terminal module, including a plurality of second terminals arranged parallel to and spaced from one another, and the rear end of each second terminal being extended and bent backwardly and having a second pin, and the second terminal module being installed with an interval from a side of the first terminal module; a grounded metal plate, installed with an interval between the first terminal module and the second terminal module, and having at least one through hole formed at the front end of the grounded metal plate and at least one third pin installed at the rear end of the grounded metal; an insulating body, integrally formed and covering the first terminal module, the second terminal module and the grounded metal plate by an insert molding method, and having a tongue plate formed at a front section of the insulating body front section, so that the first terminal module and the second terminal module are disposed on upper and lower surfaces of the tongue plate respectively, and the first pins, the second pins and the third pins being extended out from the rear end of the insulating body, and a snap portion being formed separately on two side edges of the insulating body; an inner shield casing, fixed at the snap portion, and covering a middle section of the insulating body; and an outer shield casing, covering the exterior of the insulating body, and surrounding the external space of the tongue plate to form an engaging portion.

In an embodiment, each snap portion includes a pair of oblique projections, and each pair of oblique projections have bevels arranged in opposite directions to each other, and the inner shield casing includes a first metal member and a second metal member with a shape corresponsive to the shape of the insulating body, and each of two end portions of the first metal member and the second metal member has a through hole corresponsive to each oblique projection for fixing the first metal member and the second metal member by a top-to-bottom engaging method, and the first metal member and the second metal member can be arranged adjacent to each other and engaged to form a surface, so as to improve the convenience of assembling and enhance the covering and shielding effects.

To reduce the exposure of the exterior of the insulating body from the bending position of the first terminal module and the second terminal module which may cause noises in a signal transmission, the present invention specially covers the horizontal bending position of the first terminals and the second terminals into the insulating body, so that the first pins and the second pins at the rear end of the first terminals and the second terminals are no longer needed to be bent into different angles in the manufacturing process, so as to reduce the chance of being damaged and enhance the high frequency transmission.

In another embodiment, the first pins of the first terminal module and the second pins of the second terminal module are bent and the bottom side of the bent first pins and second pins are disposed on the same plane, so that the surface mount technology (SMT) operation of the finished goods can be performed successfully. In addition, the present invention further comprises a metal support installed at the bottom of the outer shield casing and serving as an aid of the SMT operation and covering the outer shield casing to improve the noise shielding effect.

DETAILED DESCRIPTION OF THE PREFERRED EMBODIMENTS

Figure 1:
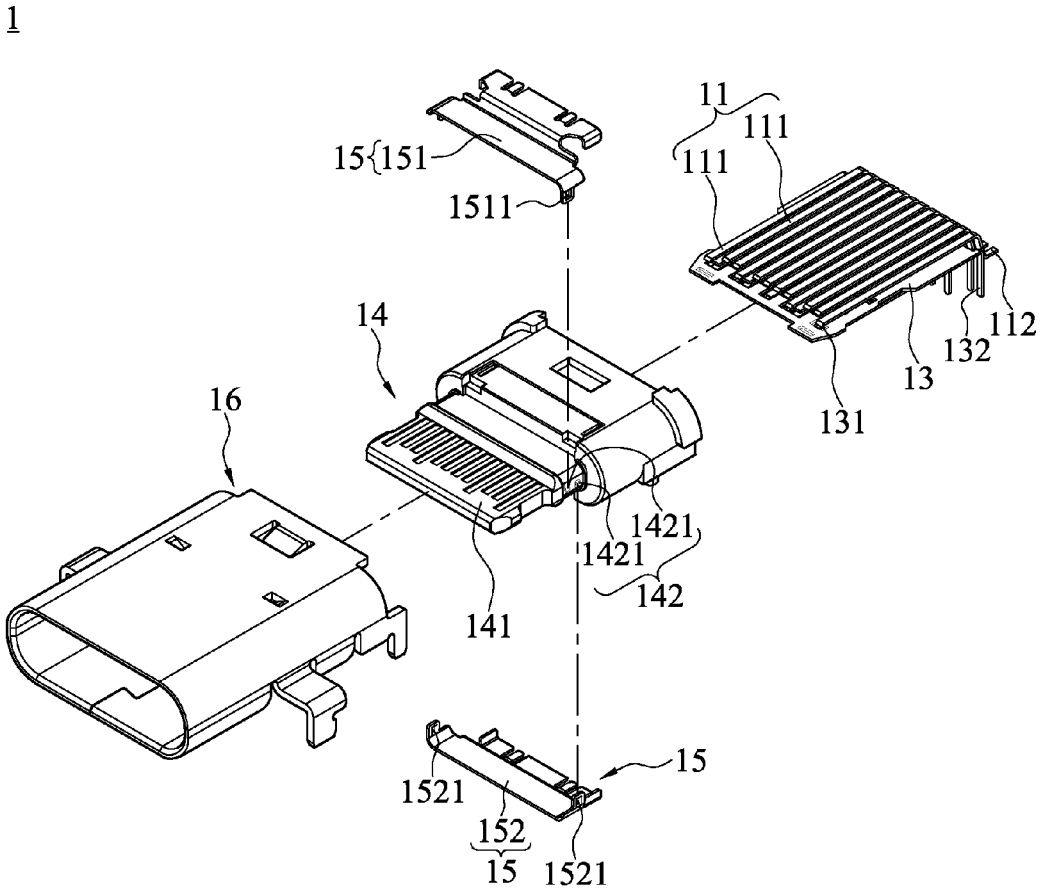
FIG. 1 is an exploded view of an electric connector assembly in accordance with a preferred embodiment of the present invention, viewing from the front side of the electric connector assembly.
Figure 2:
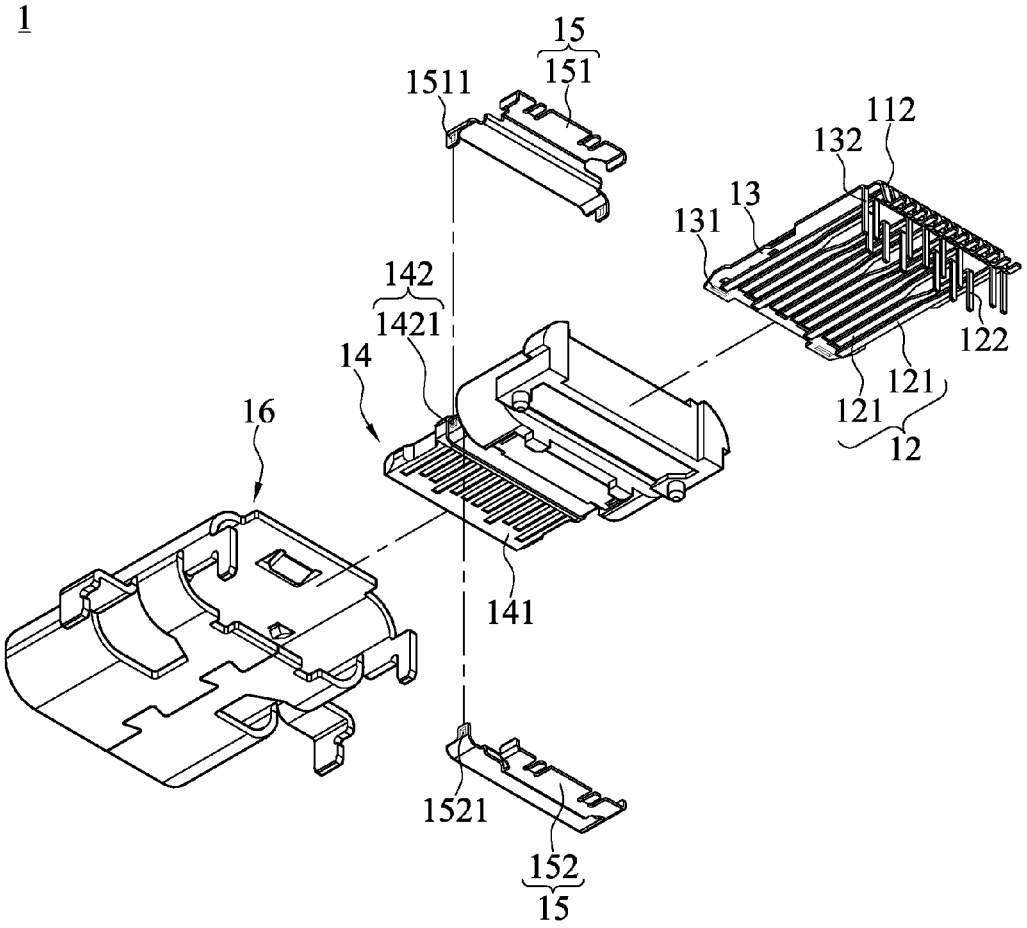
FIG. 2 is an exploded view of an electric connector assembly in accordance with a preferred embodiment of the present invention, viewing from the reverse side of the electric connector assembly.
Figure 3:
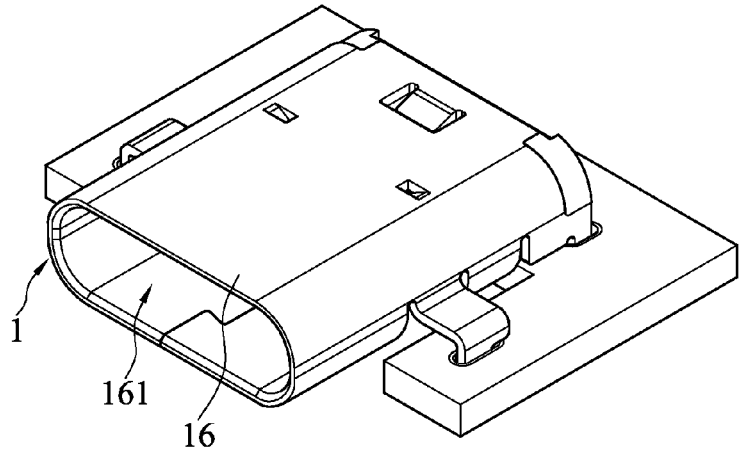
FIG. 3 is a perspective view of an electric connector assembly in accordance with a preferred embodiment of the present invention.
Figure 4:
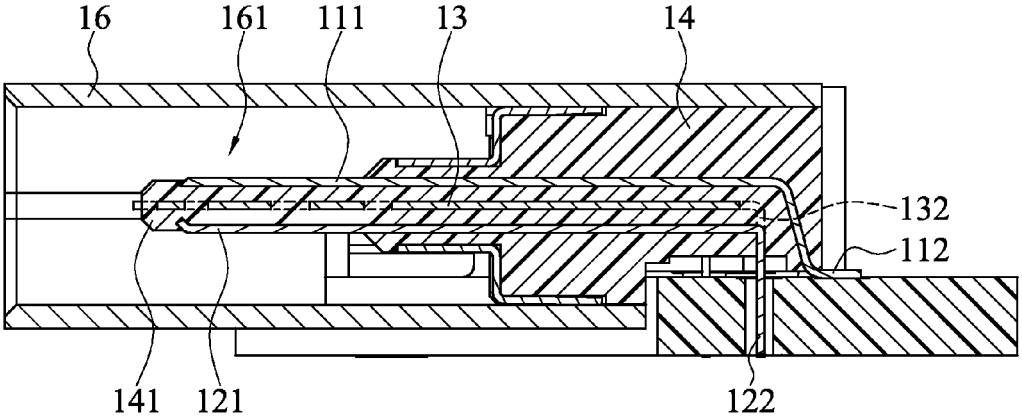
FIG. 4 is a cross-sectional view of an electric connector assembly in accordance with a preferred embodiment of the present invention.
Figure 5:
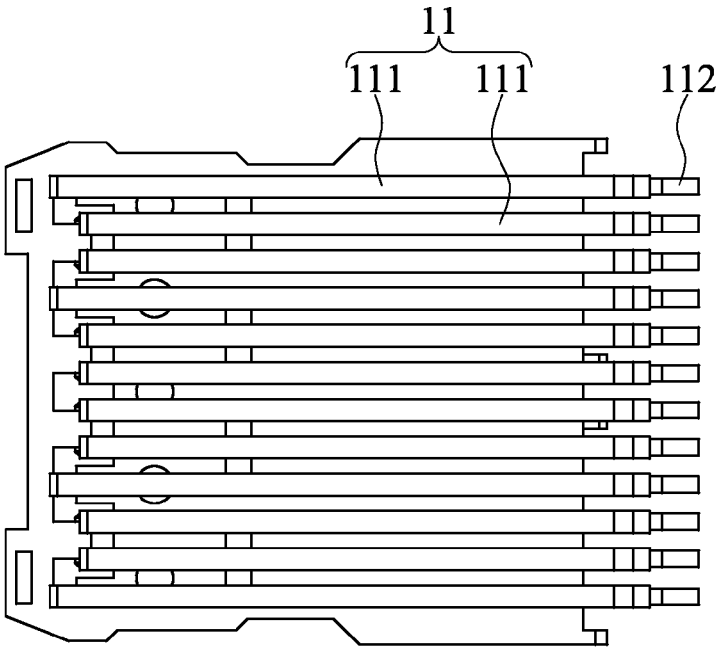
FIG. 5 is a bottom view of a first terminal module of an electric connector assembly in accordance with a preferred embodiment of the present invention.
Figure 6:
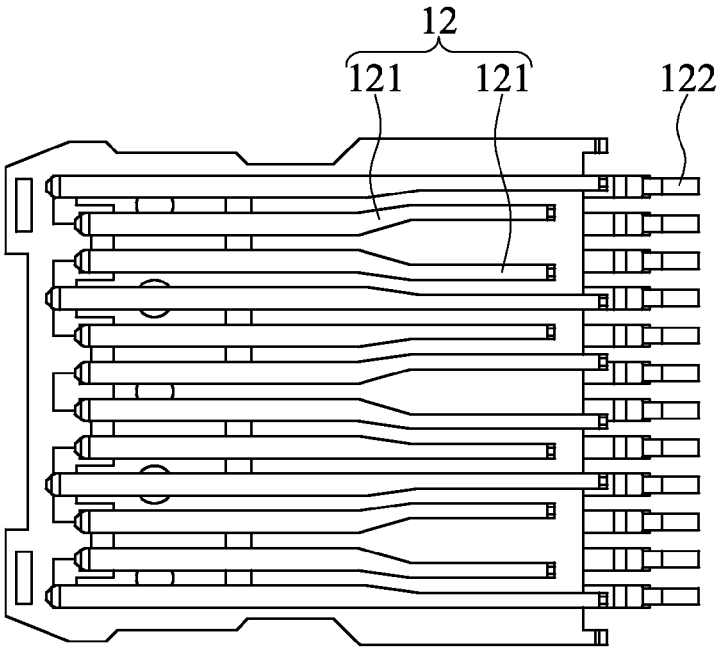
FIG. 6 is a bottom view of a second terminal module of an electric connector assembly in accordance with a preferred embodiment of the present invention.

The technical content of the present invention will become apparent with the detailed description of preferred embodiments and the illustration of related drawings as follows.

With reference to FIGS. 1 to 6 for exploded views of both sides of an electric connector assembly, a perspective view and a cross-sectional view of the electric connector assembly, and bottom views of a first terminal module and a second terminal module of the electric connector assembly in accordance with a preferred embodiment of the present invention respectively, the electric connector assembly 1 comprises a first terminal module 11, a second terminal module 12, a grounded metal plate 13, an insulating body 14, an inner shield casing 15 and an outer shield casing 16.

Wherein, the first terminal module 11 includes a plurality of first terminals 111 arranged parallel to and spaced from one another, and the rear end of each first terminal 111 is bent and has a first pin 112 installed vertically.

The second terminal module 12 includes a plurality of second terminals 121 arranged parallel to and spaced from one another, and the rear end of each second terminal 121 is extended and bent backwardly and has a second pin 122, and the second terminal module 12 is being installed with an interval from a side of the first terminal module 11.

The grounded metal plate 13 installed with an interval between the first terminal module 11 and the second terminal module 12, and has a plurality of through holes 131 formed at the front end of the grounded metal plate 13 and a pair of third pin installed at the rear end of the grounded metal. It is noteworthy that the through holes 131 are provided for passing the materials used for making the insulating body 14 during the snap-in molding process and a fixed structure can be formed after the molding, so as to prevent the grounded metal plate 13 from being loosened or separated easily.

The insulating body 14 is integrally formed to cover the first terminal module 11, the second terminal module 12 and the grounded metal plate 13 by an insert molding method, and a tongue plate 141 is formed at a front section of the insulating body 14, so that the first terminal module 11 and the second terminal module 12 are disposed on upper and lower surfaces of the tongue plate 141 respectively, and the first pins 112, the second pins 122 and the third pins 132 are extended out from the rear end of the insulating body 14. In addition, a snap portion 142 is formed separately on two side edges of the insulating body 14, and each snap portion 142 has a pair of oblique projections 1421 arranged adjacent to each other, and each pair of oblique projections 1421 have bevels arranged in opposite directions to each other. In addition, the horizontal turning positions of the first terminals 111 and the second terminals 112 of the present invention are covered in the insulating body 14 to reduce the exposure of the exterior of the insulating body 14 from the bending position of the first terminal module 11 and the second terminal module 12 which may cause noises in a signal transmission, and the first pins 112 and the second pins 122 are no longer needed to be bent into different angles in the manufacturing process, so as to reduce the chance of being damaged and enhance the high frequency transmission.

The inner shield casing 15 includes a first metal member 151 and a second metal member 152 with a shape corresponsive to the shape of the insulating body 14 and used for fixing at the snap portion 142 to cover the middle section of the insulating body, and two end portions of the first metal member 151 and the second metal member 152 have through holes 1511, 1521 corresponsive to the oblique projections 1421 respectively and provided for fixing the first metal member 151 and the second metal member 152 with each other by a top-to-bottom engaging method. It is noteworthy that the first metal member 151 and the second metal member 152 have concave and convex end portions engaged with each other and arranged adjacent to each other to form a surface, and such arrangement can prevent any overlap during the assembling process.

The outer shield casing 16 covers the exterior of the insulating body 14 and surrounds the external space of the tongue plate 141 to form an engaging portion 161 used for connecting an electric connector (not shown in the figure).

Figure 7:
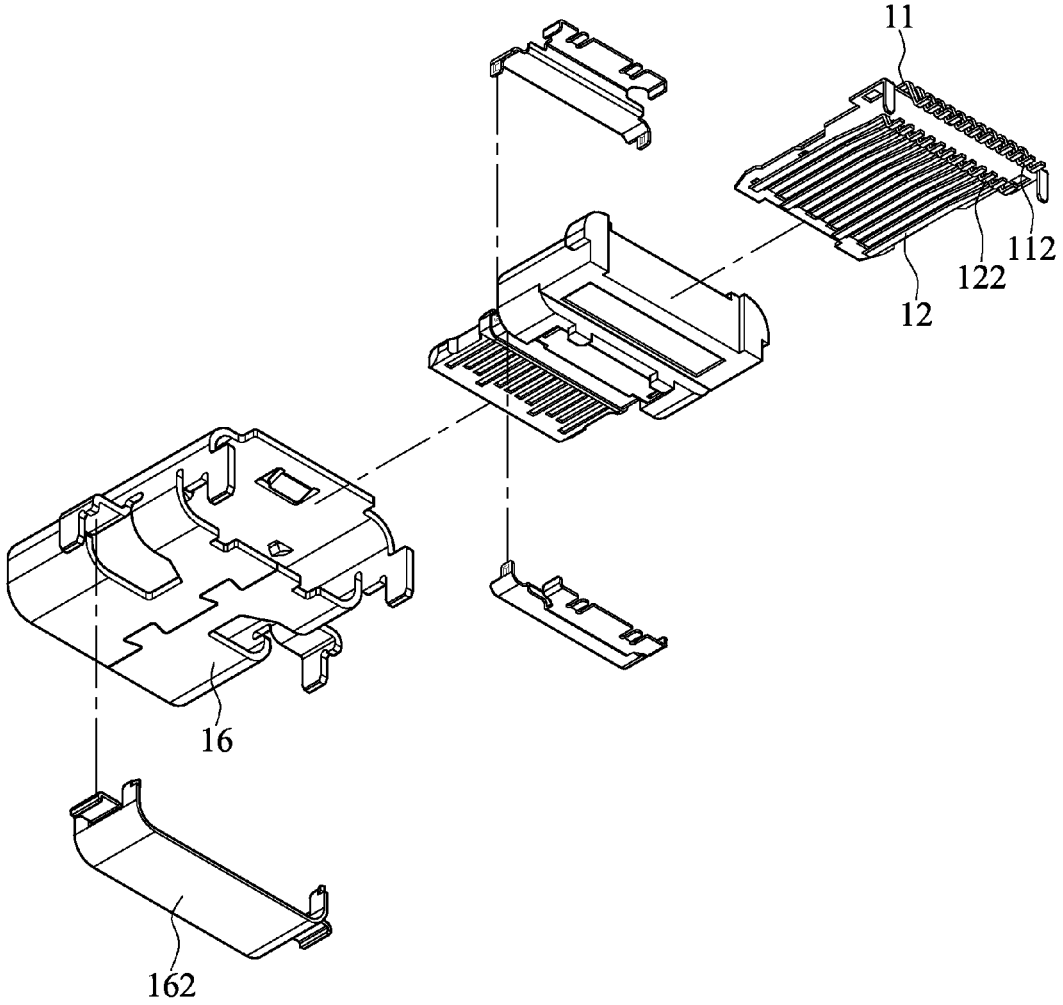
FIG. 7 is an exploded view of an electric connector assembly in accordance with another preferred embodiment of the present invention.
Figure 8:
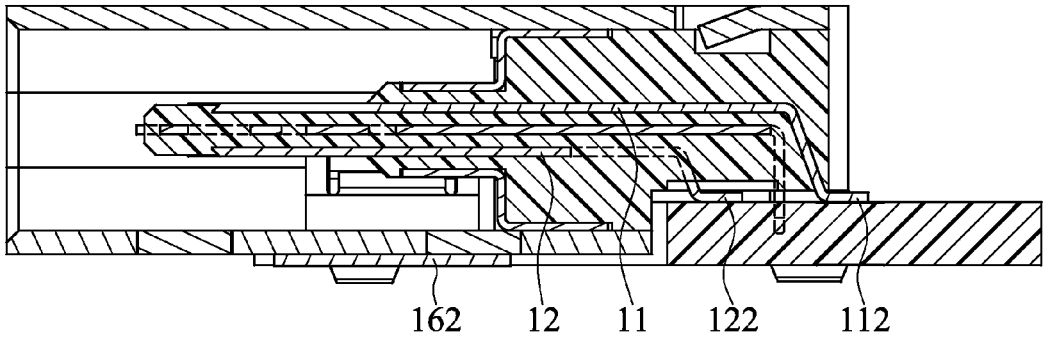
FIG. 8 is a cross-sectional view of an electric connector assembly in accordance with another preferred embodiment of the present invention.

With reference to FIGS. 7 and 8 for an exploded view and a cross-sectional view of an electric connector assembly in accordance with an other preferred embodiment of the present invention respectively, the first pins 112 of the first terminal module 11 and the second pins 122 of the second terminal module 12 the present invention are bent to facilitate the surface mount technology (SMT) operation, and the bottom sides of the bent first pins 112 and the second pins 122 are disposed on the same plane. In addition, a metal support 162 is installed at the bottom of the outer shield casing 16, wherein the metal support 162 is a U-shaped structure having a shape corresponsive to the shape of the outer shield casing 16 and serving as an aid of the SMT operation and covering any gap or breach of the outer shield casing 16 produced in the manufacturing process to improve the noise shielding effect.

What is claimed is:

1. An electric connector assembly, comprising:

a first terminal module, including a plurality of first terminals arranged parallel to and spaced from one another, and the rear end of each first terminal being bent and having a first pin installed vertically;

a second terminal module, including a plurality of second terminals arranged parallel to and spaced from one another, and the rear end of each second terminal being extended and bent backwardly and having a second pin, and the second terminal module being installed with an interval from a side of the first terminal module;

a grounded metal plate, installed with an interval between the first terminal module and the second terminal module, and having at least one through hole formed at the front end of the grounded metal plate and at least one third pin installed at the rear end of the grounded metal;

an insulating body, integrally formed and covering the first terminal module, the second terminal module and the grounded metal plate by an insert molding method, and having a tongue plate formed at a front section of the insulating body front section, so that the first terminal module and the second terminal module are disposed on upper and lower surfaces of the tongue plate respectively, and the first pins, the second pins and the third pins being extended out from the rear end of the insulating body, and a snap portion being formed separately on two side edges of the insulating body;

an inner shield casing, fixed at the snap portion, and covering a middle section of the insulating body; and an outer shield casing, covering the exterior of the insulating body, and surrounding the external space of the tongue plate to form an engaging portion.

2. The electric connector assembly of claim 1, wherein each snap portion includes a pair of oblique projections, and each pair of oblique projections have bevels arranged in opposite directions to each other, and the inner shield casing includes a first metal member and a second metal member with a shape corresponsive to the shape of the insulating body, and each of two end portions of the first metal member and the second metal member has a through hole corresponsive to each oblique projection for fixing the first metal member and the second metal member by a top-to-bottom engaging method.

3. The electric connector assembly of claim 2, wherein the first metal member and the second metal member have concave and convex end portions engaged with each other and arranged adjacent to one another to form a surface.

4. The electric connector assembly of claim 3, wherein the first terminals and the second terminals have a horizontal turning position covered in the insulating body.

5. The electric connector assembly of claim 4, wherein the first pins of the first terminal module and the second pins of the second terminal module are bent and the bottom side of the bent first pins and second pins are disposed on the same plane.

6. The electric connector assembly of claim 5, further comprising a metal support installed at the bottom of the outer shield casing.

* * * * *